US010632591B2

(12) United States Patent
Hede et al.

(10) Patent No.: US 10,632,591 B2
(45) Date of Patent: Apr. 28, 2020

(54) POLISHING PAD AND MATERIAL AND MANUFACTURING METHOD FOR SUCH

(71) Applicant: KWH MIRKA LTD, Jeppo (FI)

(72) Inventors: Hans Hede, Vörå (FI); Göran Höglund, Nykarleby (FI)

(73) Assignee: KWH MIRKA LTD, Jeppo (FI)

( * ) Notice: Subject to any disclaimer, the term of this patent is extended or adjusted under 35 U.S.C. 154(b) by 134 days.

(21) Appl. No.: 15/537,774

(22) PCT Filed: Jan. 28, 2015

(86) PCT No.: PCT/FI2015/050056
§ 371 (c)(1),
(2) Date: Jun. 19, 2017

(87) PCT Pub. No.: WO2016/120516
PCT Pub. Date: Aug. 4, 2016

(65) Prior Publication Data
US 2018/0215011 A1 Aug. 2, 2018

(51) Int. Cl.

| | |
|---|---|
| ***B24D 13/14*** | (2006.01) |
| ***B24D 11/02*** | (2006.01) |
| ***B24B 37/24*** | (2012.01) |
| ***B24B 29/00*** | (2006.01) |
| ***B24D 11/00*** | (2006.01) |

(52) U.S. Cl.
CPC ..... *B24D 13/147* (2013.01); *B24B 29/00* (2013.01); *B24B 37/24* (2013.01); *B24D 11/003* (2013.01); *B24D 11/02* (2013.01); *B24D 13/14* (2013.01)

(58) Field of Classification Search
CPC .... B24D 13/147; B24D 11/02; B24D 11/003; B24D 13/14; B24B 29/00; B24B 37/24
USPC ..... 451/532
See application file for complete search history.

(56) References Cited

U.S. PATENT DOCUMENTS

| | | | | |
|---|---|---|---|---|
| 3,005,747 | A * | 10/1961 | Van Schoor | A01N 37/18 514/625 |
| 3,009,822 | A * | 11/1961 | Griswold | D04H 1/66 428/195.1 |
| 5,375,289 | A * | 12/1994 | Miyaoka | B24B 23/02 15/230 |
| 5,893,191 | A | 4/1999 | Schneider et al. | |
| 6,024,634 | A | 2/2000 | Hoglund et al. | |
| 6,453,502 | B1 * | 9/2002 | Bishop | A47L 13/12 15/118 |

(Continued)

FOREIGN PATENT DOCUMENTS

| | | | | |
|---|---|---|---|---|
| DE | 199 42 741 | A1 | 5/2001 | |
| DE | 19942741 | A1 * | 5/2001 | B24D 13/14 |

(Continued)

OTHER PUBLICATIONS

Machine Translation of JP 2010274338 A (Year: 2018).*

(Continued)

*Primary Examiner* — Eileen P Morgan
(74) *Attorney, Agent, or Firm* — Oliff PLC

(57) ABSTRACT

A polishing pad for polishing a surface, material for a polishing pad and a method for manufacturing material for a polishing pad. A polishing pad has a backing layer and a polishing layer made of sheep wool fibres fixed onto a surface of the backing layer, wherein the polishing layer has loops made of sheep wool fibres.

20 Claims, 3 Drawing Sheets

(56) References Cited

U.S. PATENT DOCUMENTS

| | | | | |
|---|---|---|---|---|
| 2007/0178273 | A1 | 8/2007 | Provost et al. | |
| 2010/0112325 | A1* | 5/2010 | Iwamoto | A47L 13/16 428/221 |
| 2017/0355064 | A1* | 12/2017 | Eisenblaetter | B24D 13/12 |
| 2018/0001342 | A1* | 1/2018 | Roberts | B05D 1/02 |

FOREIGN PATENT DOCUMENTS

| | | | | |
|---|---|---|---|---|
| EP | 1306162 | A1 | | 5/2003 |
| JP | 2002-001645 | A | | 1/2002 |
| JP | 2002-078511 | A | | 3/2002 |
| JP | 2003-124164 | A | | 4/2003 |
| JP | 2004-358588 | A | | 12/2004 |
| JP | 2010-057813 | A | | 3/2010 |
| JP | 2010-274338 | A | | 12/2010 |
| JP | 2010274338 | A | * | 12/2010 |

OTHER PUBLICATIONS

Machine Translation of DE 19942741 A1 (Year: 2018).*
Sep. 22, 2015 Search Report issued in International Patent Application No. PCT/FI2015/050056.
Sep. 22, 2015 Written Opinion issued in International Patent Application No. PCT/FI2015/050056.
Apr. 21, 2017 International Preliminary Report on Patentability issued in International Patent Application No. PCT/FI2015/050056.
Oct. 19, 2018 extended European Search Report issued in European Patent Application No. 15879773.8.

* cited by examiner

POLISHING PAD AND MATERIAL AND MANUFACTURING METHOD FOR SUCH

TECHNICAL FIELD

The invention relates to a polishing pad for polishing a surface, material for a polishing pad and a method for manufacturing a polishing pad and material for a polishing pad.

BACKGROUND

Different kind of surfaces can be processed by sanding and polishing. Sanding and polishing may provide better surface quality, smoothness, appearance and gloss. The surface material may comprise metal, mineral, plastics, or alike, and the surface may comprise lacquer, paint, or other coating. After sanding phase, the surface may still have sanding stripes. Polishing is done to finalize the surface. Polishing may aid in removing sanding stripes, coating failures, wear traces, oxidation or alike irregularities.

Sheep wool is a commonly used material in polishing pads. In general natural fibres of sheep wool provide good polishing effect. However, there are many different kinds and quality of sheep wool depending for example on living environment of the sheep, like climate and geographical location. Further there are variations among different breeds and among a single sheep skin rug. When and how the sheep skin rug has been cut before the skin is treated has also effect on end product quality.

SUMMARY

Object of the application is to provide a polishing pad enabling good quality polishing result. Embodiments aim to provide an improved polishing pad.

According to an embodiment a polishing pad comprises a backing layer and a polishing layer made of sheep wool fibres fixed on a surface of the backing layer, wherein the polishing layer comprises loops made of sheep wool fibres.

According to an embodiment material for a polishing pad comprises a backing layer and a polishing layer made of sheep wool fibres fixed on a surface of the backing layer, wherein the polishing layer comprises loops made of sheep wool fibres.

An embodiment comprises a method for manufacturing material for a polishing pad according to embodiments. Another embodiment comprises a method for manufacturing a polishing pad according to embodiments.

DESCRIPTION OF THE DRAWINGS

In the following the embodiments are described in further detail with the accompanying Figures, of which.

DETAILED DESCRIPTION

According to embodiments a polishing pad comprises a backing layer and a sheep wool fibres weft-knitted or woven into the backing layer. The weft-knitted or woven sheep wool fibres form a loop structure onto the backing layer. Before knitted, the sheep wool fibres may be in the form of fluffy slivers, made of sheep wool. The loops extend upwards from the backing layer surface. The loops form a polishing surface of the polishing pad. The polishing pad according to embodiments is usable with a polishing tool, like a sanding or a polishing machine. The polishing pad is attachable to a polishing tool.

The loop structure comprises sheep wool. Sheep wool comprises a natural fibre. Sheep wool fibres comprise keratin. Sheep wool fibres form clusters or bundles. Clusters of sheep wool fibres are formed by individual fibres, which have ability to attach to each other so that they stay together. Clipped sheep wool may be carded and slivered. In some embodiments spun wool may be utilized. Fibres of the wool tend to disentangle and intermix during carding. Individual fibres will be aligned parallel to each other. Different kind of fibres, for example from different sources, may be mixed before carding. Carding has effect of lining up fibres. After carding, the wool is in the form of sliver, like a large fluffy rope of fibres. According to the embodiments, used continuous carded sliver of wool fibres is typically airy, fluffy or loose, not tightly packed. This enables increasing area for polishing and for bonding polishing agent. The embodiments enable less individual differences between and in skin rugs. Before carding wool is cleaned and mixed from more than one sources. Thereby the quality of the processed wool is equalized. Animals may be of the same breed and/or of the same kind. Alternatively different kind of wool types may be mixed. Because sheep wool comprises pronounced shingle structure on the fibre surface, it provides enhanced polishing effect due to keeping abrasive particles onto the fibres. Different sheep wool types may be chosen for a specific end use. This enables providing the wanted polishing result for the desired kind of surface(s) according to the chosen wool types.

Figure 1:
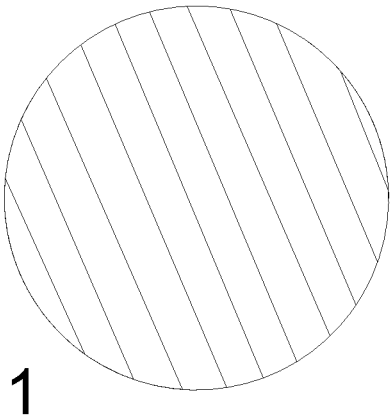
FIG. 1 illustrates a polishing pad according to an embodiment.

FIG. 1 illustrates a polishing pad according to an embodiment. FIG. 1 illustrates a top view of a circular polishing pad. The polishing pad may be circular or rectangular, or of any suitable shape. The polishing surface is illustrated in the FIG. 1. The polishing surface comprises sequential loop structures. Sequential loops form kind of lines visible on a surface of a polishing pad of FIG. 1. Lines are formed by stitch lines, which fix sheep wool fibres from a sliver into a backing layer. Between stitch lines sheep wool fibres form arcs of the sheep wool fibre loops. The pad comprises adjacent lines of loops. The lines may form even, uniform lines or rows, as illustrated in the FIG. 1. Alternatively, neighbouring loops may be positioned randomly. In this case the surface structure comprises loops in a random order, without any visible lines on the pad surface.

Figure 2:
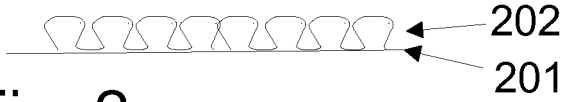
FIG. 2 illustrates a side view of a polishing pad according to an embodiment.

FIG. 2 illustrates a side view of a polishing pad according to an embodiment. The polishing pad comprises a polishing layer 202 and a backing layer 201. The backing layer forms a base for the polishing pad. The backing layer may be an underlay, a background or alike for the polishing pad. Backing layer 201 may be made of knitted cloth, woven fabric, non-woven fabric, or other suitable material or combination thereof. In an embodiment a backing layer is knitted of polyester yarn. The backing layer 201 may imitate skin of an animal. The backing layer 201 may be knitted or woven. The backing layer according to an embodiment is flexible.

A polishing layer 202 is arranged into a surface of the backing layer 201. The polishing surface 202 comprises loop structure. The loops according to embodiments are knitted, weft-knitted or woven into the backing layer 201. A continuous wool fibre sliver is fixed into the backing layer so that loops are formed between two sequential fixing points. The loops comprise two legs attached into the backing layer 201 and an arc portion between the two legs. The arc portion connects two substantially parallel legs to each other, forming a continuous loop structure. The loops extend from the backing layer surface, into which those are fixed. In addition, loops may have support from the loops next to them. Further, sheep wool fibre bundles are partly spun and integrated with yarn of the backing layer. Thus loops are partly incorporated into the backing layer.

A polishing layer is made of wool fibre sliver. After fixed with a backing layer, the polishing layer is in the form of wool fibre loops. The wool fibres of the polishing layer form also part of the backing layer. The backing layer may comprise yarn and wool fibres. Yarn may form minor part of the backing layer.

Figure 3A:
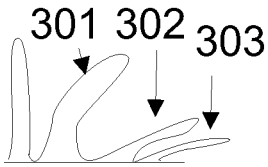
FIG. 3*a* illustrates a side view of a polishing pad according to an embodiment.
Figure 3B:
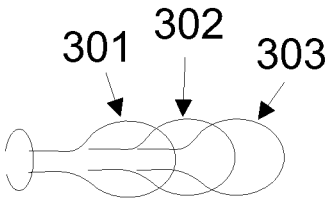
FIG. 3*b* illustrates a top view of a polishing surface according to an embodiment.

FIGS. 3*a* and 3*b* show a pad according to embodiments during use. FIG. 3*a* is a side view of a pad and FIG. 3*b* is seen from above the pad surface. The pad of the FIG. 3*ab* is moved and pressed towards a surface to be polished. The movement may comprise circular motion. FIG. 3*ab* show loop 303, which is bent under pressure in accordance to the movement direction, opposite to it. The loop 302 next to the loop 303 is bent similarly, in the same direction with the loop 303. Loop 301, next to the loop 302, is starting to bend similarly, in the same direction with the loops 302, 303. The FIG. 3*b* illustrates how the loops bend on top of each other. Loop structure avoids legs of the loops 301, 302, 303 from entangling with each other. Arc portions cross leg portions of the loops thus avoiding parallel arrangements of fibres, and/or maintaining airy, fluffy construction of the loops.

A conventional pad without a loop structure according to embodiments, like natural sheep skin, has tendency to pack tightly under working pressure. Further, straight, oblong wool fibres, extending outwards from a skin or a backing layer, tend to be flattened, when used with a rotating tool. Fibre bundles, which originally extend outwards from the backing surface, tend to turn parallel. Push and rotation re-arrange wool fibres/fibre bundles. Directions of fibre bundles in view of each other become organized. Polishing surface according to embodiments avoids tight packing due to loop structure of the polishing surface. The legs of the loops may bend under the polishing pressure and rotation of used polishing tool. The arc portions connecting two legs provide a structure perpendicular to the legs. Thus the legs are not packed tightly, nor flattened, but arc portions of the loops are arranged to cross the legs in non-parallel manner. This enables the wool fibres in a loop structure to remain voluminous and fluff. Polishing agent is maintained into the loop structure, inside and between the loops, whereas straight wool fibres tend to guide polishing substrate away along straight fibres/fibre bundles, in accordance to a movement of a polishing pad.

Polishing agent may comprise abrasive component(s) in order to have abrasive effect on the polished surface. Polishing agent may comprise wax components for filling minor scratches and/or cavities of the polished surface. Polishing agent may leave glossy protective coating on the polished surface. Polishing agent may have any combination of abrasive, filling and coating effects.

During use of a pad according to embodiments arc portions of the loops are positioned perpendicular to the direction of movement of the polishing tool. This enables providing of a smooth, flat sweep over a surface to be polished. The loops enable arcs to be positioned similarly along a polishing surface in response to tool movement, whereas without a loop structure, straight fibres become packed tightly parallel.

Figure 4:
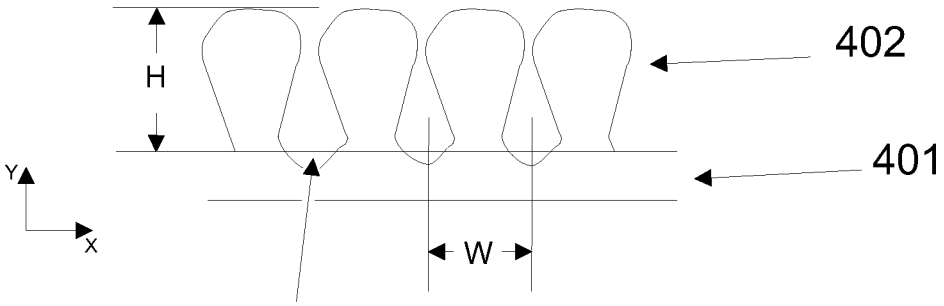
FIG. 4 illustrates a side view of a polishing pad according to an embodiment.

FIG. 4 illustrates a side view of a polishing pad material. Sheep wool fibres are fixed into a backing layer 401 such that the wool fibres form loops 402 between fixing points 403. The sheep wool fibres are preferably longer than the length of a loop.

In the side view of FIG. 4, the backing layer 401 forms a horizontal level along x-axis. The loops 402 extend from the backing layer level. The loops are at least approximately perpendicular to the backing layer. Thus the loops have a height h in the direction of y-axis in the FIG. 4.

Loops comprise a height h. This may be illustrated as arc height of the loops, or loop height from the backing layer. The loops comprise arc height of 5-25 mm, preferably 7-20 mm, more preferably 8-13 mm from the backing layer.

The pad according to embodiments comprises a polishing surface, which is voluminous. The loops comprise certain density. A pad may comprise polishing wool surface weight of at least 500 g/m$^2$, preferably 500-1500 g/m$^2$, more preferably 700-1200 g/m$^2$. The surface weight refers to polishing layer surface weight, i.e. loops or wool fibres, not the separate thread material of the backing layer. Polishing surface comprises wool loops. Wool loops comprise wool fibres. This has effect on polishing result and on amount of used polish. Voluminous polishing surface comprises lot of area for receiving polishing agent. Polishing agent is maintained inside the loop structure during polishing. The arc structure aids in keeping the polish in the area of the pad and avoids throwing it out from the pad area. The polish is effectively used and amount of waste or non-used, thrown out polish is reduced.

The loops of the polishing pad according to an embodiment comprise sheep wool. The loops are knitted, weft-knitted or woven sheep wool fibre slivers. The sliver may be made of carded sheep wool fibres. For example, sheep wool is known to naturally have good polishing effect. However, quality between animals, breeds, and even among a single skin rug, may differ. Also, use of natural animal skin requires killing the animal. This is not required according to embodiments. In accordance to the embodiments, the animal may stay alive and its wool production may continue. Natural wool from animals is utilized according to embodiments. The wool is originated from at least two, or several, different sources. Different source may refer to different kind of sheep wool or sheep wool fibre, different animal, different breed, for example. Sheep wool of at least two or several sources are mixed. This enables to reduce variations in quality. The mixed wool according to embodiments may originate from animals of the same breed. Wool types of different kind may be chosen according to desired use of the pad. It is possible to utilize geographical differences between sheep. For example Australian Merino sheep typically have finer wool fibres compared to European sheep. Australian Merino sheep may have fibres from very fine to more coarse, around 11-26 microns (μm=$10^{-6}$ m) in diameter. Fibre length may vary between 30-90 mm. Diameter and length of fibres vary depending on growing conditions and animal husbandry, for example. Some European sheep have fibre diameter of 28-25 microns and fibre length of 50-120 mm; or fibre diameter of 30-40 microns and fibre length of 80-150 mm. The fibre diameter may be even up to 60 microns and fibre length up to 380 mm. The fine Merino wool is durable and easy to handle. Merino wool is mixable with fibres of other kinds. Different kind of wools and different combinations may provide desired polishing results for different surfaces or surface materials. As an example, 100% European type of sheep wool provides mainly abrasive effects, but may not be sufficient for a desired gloss results, while Australian Merino wool may provide dominantly fine polishing effect, that is high gloss, but lack abrasive effect. A mixture of 50:50 European and Australian Merino wool enables providing balanced ratio between abrasive and polishing properties.

Different sheep wool types may be mixed in order to form sliver according to embodiments. Utilizing different kinds of sheep wool, for example from several animals, enables avoiding of individual variations among animals or among a single animal skin. The sheep wool fibre according to embodiments comprises relatively uniform quality in the area of the pad surface and/or among number of pads. Relatively uniform refers to macroscopic quality, while microscopic deviations may occur. The quality may be effected by the used sheep wool type(s). According to embodiments the quality of used wool fibres is predictable. The quality of sheep wool fibres according to embodiments may be equalized, or more consistent compared to natural sheep wool, for example. Individual variations among polishing pads or their polishing surface material may be significantly reduced.

The sheep wool fibre sliver is knitted, weft-knitted or woven into the backing layer so that wool fibres forms loops. The wool fibres may be at least partly integrated with the yarn(s) of the backing layer. The wool fibres may be circular weft-knitted according to ISO 8388 3.0.2. A circular weft-knitting machine may be used. The circular weft-knitting machine may comprise 12 knitting units combined with 6 or 9 sliver feeding units, or number of knitting units may be equal with the number of feeding units. In case the number of feeding and knitting units is the same, the formed loops form a homogenous surface area, without any visible lines (cf. FIG. 1). The sliver units are arranged to insert and fold the wool fibre sliver into the knitting units. Wool fibre loops are formed over a platine by fixing the fibres in the form of a loop into the backing layer. Thus there is a loose wool fibre portion forming a loop of desired height between two fixing points. According to an embodiment backing layer and polishing loops on its surface are knitted simultaneously. The loop height may be selected according to desired end use, for example according to the surface to be polished. A thin polishing layer, made of relatively short height loops, may be used for a flat surface compared to an uneven surface, which may comprise curvature or deeper portions, wherein taller loop height and thicker polishing layer provides better polishing results.

A backing layer may comprise woven flexible textile. According to an embodiment, the backing layer may comprise thickness of about 1.5 mm or less. Loops are voluminous and tend to loosen or take more space horizontally, whereby the backing layer tends to curl, at least on its corner edge parts. This is illustrated in the FIG. 5*a*. The backing layer 501 is curved, or rolling around itself. The loops 502 of the polishing layer are on the external curve of the backing layer 501. Legs or side portions 502*a* of the loops 502 have more space in such curved position of a pad. Legs 502*a* of loops may comprise more air between neighbouring legs, instead of being in tight contact with the neighbouring loop. The loops may take a shape towards more roundish shape from the original oval loop shape. The backing layer according to embodiments is impregnated in order to provide rigidity to the structure.

Figure 5A:
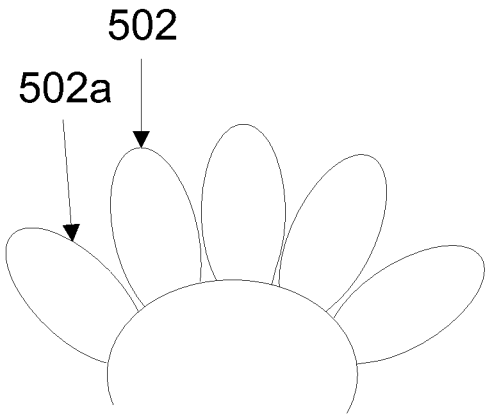
FIG. 5*a* illustrates a side view of a polishing pad according to an embodiment.
Figure 5B:
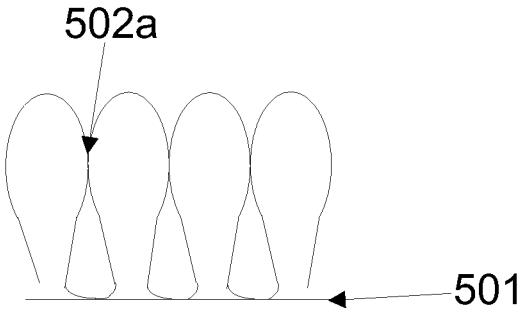
FIG. 5*b* illustrates a side view of a polishing pad according to an embodiment.

In the FIG. 5*b* the backing layer 501 forms a straight plane into which loops 502 are formed. The backing layer may be impregnated in order to maintain its straight form. In a straight form of the pad loops 502 are arranged tightly next to each other. Each loop is in contact with the loop(s) next to it. The loops take an oval shape corresponding to the available space between the neighbouring loops. In the arrangement of FIG. 5*b* compared to that illustrated in FIG. 5*a*, the loops comprise less degrees of freedom, less abilities to move and are less likely to change their orientation or shape without an external force. The loops support each other in the construction of FIG. 5*b*. This enables providing stable construction, which sustains pressure.

As illustrated with the FIG. 5*ab* impregnating the backing layer provides besides dimensional stability also clear functional effects. The impregnation of the backing layer has an effect of locking the sheep wool fibre loops into the backing layer. The polishing surface of wool fibre loops has wear resistance due to impregnation and anchoring of wool fibre loops into the structure. Another effect of impregnation is preventing used polishing agent from penetrating the pad backing. This avoids the polishing agent passing towards the polishing tool. Additionally, the impregnation enhances attachment of another layer to the backing layer. Further, a straight, flat backing layer is achieved. Impregnated backing layer provides dimensional stability to the whole pad. It enables providing vertical loops in view of a horizontal backing layer. The loops extend at least essentially perpendicular from the backing layer. A tight loop structure holds its shape and dimensions. The loops induce certain force to the loops next to it. The inter-loop force enables keeping the structure stable and in shape. Height of the loops is also relevant in the structure. Small loop heights, for example less than 5 mm, provide too hard polishing surface. The polishing result is not effective. Whereas long loop heights, for example over 25 mm, or over 35 mm, lack dimensional stability. Long loops lack support towards the neighbouring loop and the polishing surface is not as solid. Also longer fibres would be required for longer loops to be formed.

The ratio between amount of wool fibres and height of the wool fibre in a pad has effect on polishing performance. The amount of wool fibres and the loop height in a polishing pad are adjustable. The amount of wool fibres and loop height may be adjusted to provide a polishing pad surface with bulk toughness and compression resistance. Short loops make the surface too hard, whereas overly tall loops make the surface too loose. Properly selected loop height and amount of wool fibres enable providing polishing surface with sufficient elasticity and flexibility.

Figure 6A:
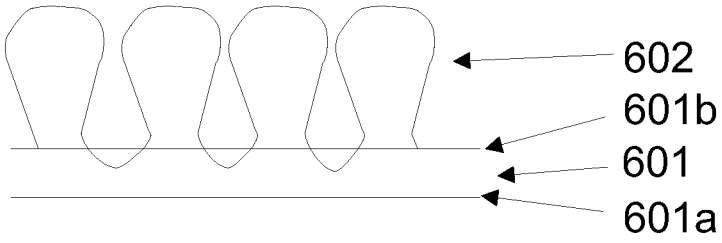
FIG. 6*a* illustrates a side view of a polishing pad according to an embodiment.

FIG. 6*a* illustrates a side view of pad layers according to an embodiment. According to an embodiment a polishing pad comprises a backing layer 601 and a polishing layer 602. Sheep wool fibres of polishing layer 602 are knitted, weft-knitted or woven into the backing layer 601. Some portions of wool fibres are thus incorporated into the backing layer 601, due to fixing wool fibre loops into the backing layer 602. A backing layer 601 of FIG. 6 is impregnated. Impregnation has effect of anchoring the loops 602 to the backing layer 601 and avoiding fibres to be drawn out from the backing layer 601. A backing layer 601 is impregnated in a manner that the impregnation agent is applied from a back surface 601*a*, opposite to the polishing surface 601*b* of the backing layer 601. Impregnation adhesive may be employed. Adhesive may comprise latex. The impregnation agent proceeds towards the polishing surface 601*b* of the backing layer 601. The backing layer 601 absorbs the impregnation agent. The impregnation agent does not proceed to the polishing surface 602. Due to lack of capillary forces the impregnation does not exceed to further than the backing layer. By combining certain impregnation resin and backing yarn the absorbance into the backing may be improved, but absorbance into the wool surface layer avoided. The impregnation agent will have an effect of providing stability and strength to the backing layer and to the pad structure. For example a backing layer may maintain a straight flat shape due to impregnated adhesive. Otherwise the backing layer may tend to wind at its edges, as illustrated in the FIG. 5*a*.

In order to control impregnation process, the impregnation adhesive may be coloured. For example a bright colour, for example red, enables a clear visualizing of the penetration of the adhesive into the backing layer. A coloured impregnated material enables to make a fast and easy quality check to the loop structure with a microscope, for example. Colour, which is impregnated to the backing layer, is visible between the loops from the polishing surface side as well as in cut cross-sections. This enables observing and confirming that the loops are correctly impregnated and thus fixed into the backing layer.

Figure 6B:
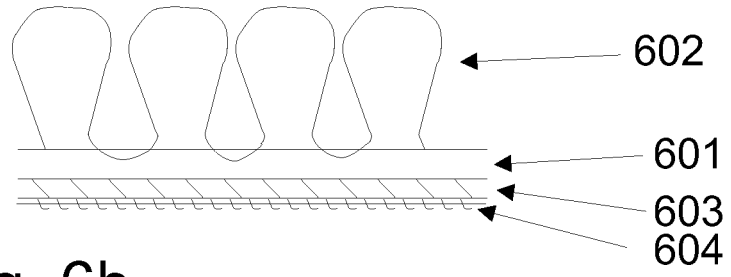
FIG. 6*b* illustrates a side view of a polishing pad according to an embodiment.

FIG. 6*b* illustrates a polishing pad according to an embodiment. A polishing layer 602 comprising wool loops is arranged to form an external surface of the polishing pad. The polishing loops 602 are fixed into a surface of a backing layer 601. Adhesive 603 is arranged on the opposite surface of the backing layer 601 (opposite to the polishing layer 602). An attachment layer 604, for example velour, may be attached to the backing layer 602 via adhesive 603. The attachment structure 604 surface, which is opposing the surface attached to the backing layer 602, comprises loop structure. The pad is arranged to be attached to a polishing tool via attachment layer 604. For example the polishing tool may comprise counterparts of the loop structure for attaching.

Figure 6C:
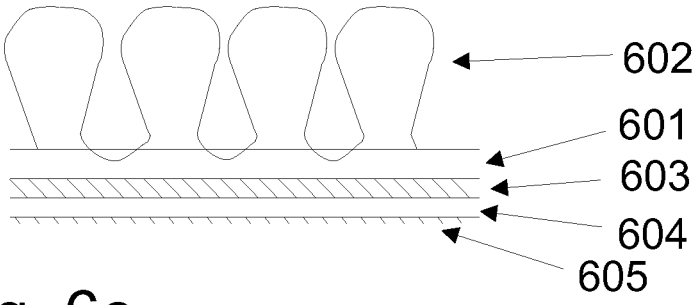
FIG. 6*c* illustrates a side view of a polishing pad according to an embodiment.
Figure 6D:
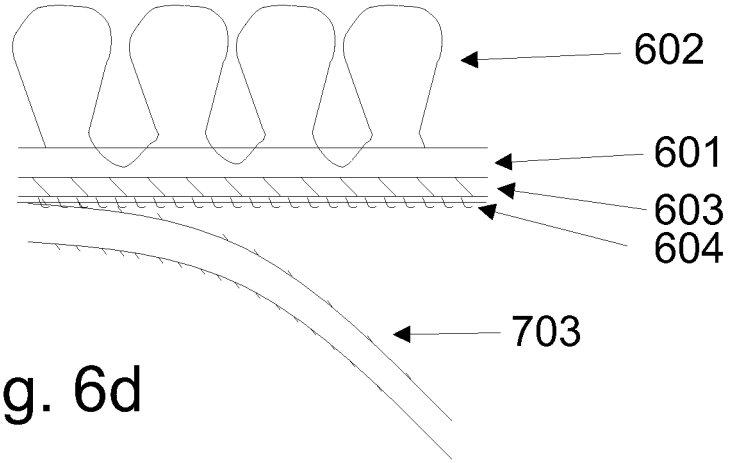
FIG. 6*d* illustrates a side view of a polishing pad according to an embodiment.

FIG. 6*c* illustrates a polishing pad according to an embodiment. Polishing layer 602 is arranged into a backing layer 601. Adhesive 603, which may be foamed, is arranged to adhesively attach the backing layer 601 and an attachment layer 604. The attachment layer 604 may comprise velour. Velour 604 is mechanically attachable to a polishing tool via hook and loop system. FIG. 6*d* shows a separate resilient intermediate layer 703, which can be used with a polishing pad similar to as illustrated in the FIG. 6*b* in order to provide desired resiliency. The separate resilient layer 703 may be detachably attached to the attachment layer 604, between the polishing pad and the polishing tool. The resilient layer 703 is a separate layer comprising parts/counterparts for mechanical attachment onto its external surfaces. Surfaces of the resilient layer 703 may comprise hooks or loops, for example. This kind of attachment layer enables fast and easy attachment and detachment of the resilient layer to the pad and/or to the polishing tool. Separate, attachable-detachable resilient layer enables employing the resilient layer and resilient properties of the polishing pad upon need. The resilient layer 703 provides abutment to different surfaces. The resilient layer 703 provides flexibility to the polishing pad, between the polishing tool and the surface to be polished. The resilient pad may, on the other hand, be utilized for example for uneven surface layer, which is to be polished. On the other hand, flat surfaces may not benefit from resilient properties, but are preferably polished without such. For flat surfaces it may be advantageous to remove a resilient layer 703. A detachable resilient layer 703 enables a single polishing pad to be used for different surfaces and provide good polishing result for different surfaces.

Embodiments provide a polishing pad and polishing material, which enable achieving good polishing effect. The polishing effect may include surface quality, smoothness and gloss. Material and construction aid in achieving polishing effect. Wool fibres forming loops of certain height, at certain density enable enhanced polishing effect. The effects with the embodiments may be improved 10-20% compared to conventional polishing pads.

A loop structure according to embodiments enables maintaining polish in the area of a polishing pad. The loop structure of the embodiments has effect of diminishing amount of used polish and contributing to an effective use of polish. Further the area surrounding the polished area remains clean, lacking polishing agent.

The invention claimed is:

1. Material for a polishing pad comprising
a backing layer and
a polishing layer made of sheep wool fibres fixed on a surface of the backing layer,
wherein the polishing layer comprises loops made of sheep wool fibres,
wherein the sheep wool fibre loops are knitted, weft-knitted or woven into the backing layer, and
wherein the polishing layer comprises surface weight of at least 500 g/m$^2$.

2. Material for a polishing pad according to the claim 1, wherein the sheep wool fibre loops comprise arc height of 5-25 mm from the backing layer.

3. Material for a polishing pad according to claim 1, wherein the polishing layer comprises surface weight of 500-1500 g/m$^2$.

4. Material for a polishing pad according to claim 1 wherein the backing layer comprises knitted or woven fabric.

5. Material for a polishing pad according to claim 1, wherein the backing layer is made of yarn and sheep wool fibres.

6. Material for a polishing pad according to claim 1, wherein the sheep wool fibres comprise sheep wool from at least two separate sources.

7. Material for a polishing pad according to claim 1, wherein the loops comprise legs attached into backing layer and arc portions connecting two legs, wherein the arc portion connecting two legs is arranged to provide a structure perpendicular with the legs.

8. Material for a polishing pad according to claim 1, wherein the backing layer is impregnated in order to lock the sheep wool fibre loops into the backing layer.

9. A polishing pad comprising
a backing layer and
a polishing layer made of sheep wool fibres fixed onto a surface of the backing layer,
wherein the polishing layer comprises loops oriented to contact a surface for polishing, the loops made of sheep wool fibres, wherein the sheep wool fibre loops are knitted, weft-knitted or woven into the backing layer, and wherein the polishing layer comprises surface weight of at least 500 g/m$^2$.

10. A polishing pad according to the claim 9, wherein the sheep fibre loops comprise arc height of 5-25 mm from the backing layer.

11. A polishing pad according to claim 9, wherein the wool polishing layer comprises surface weight of 500-1500 g/m$^2$.

12. A polishing pad according to claim 9, wherein the backing layer comprises knitted or woven fabric.

13. A polishing pad according to claim 9, wherein the backing layer is made of yarn and sheep wool fibres.

14. A polishing pad according to claim 9, wherein the sheep wool fibres are made of carded sheep wool.

15. A polishing pad according to claim 9, wherein the sheep wool fibres comprises sheep wool from at least two separate sources.

16. A polishing pad according to claim 9, wherein the loops comprise legs attached into backing layer and arc portions connecting two legs, wherein the arc portion connecting the two legs is arranged to provide a structure perpendicular with the legs.

17. A polishing pad according to claim 9, wherein the backing layer is impregnated in order to lock the sheep wool fibre loops into the backing layer.

18. A polishing pad according to claim 9, comprising a resilient layer attached to the backing layer.

19. A polishing pad according to claim 9, comprising an attachment layer, which is laminated onto the backing layer.

20. A method for manufacturing a polishing pad comprising a backing layer and a polishing layer, the polishing layer comprising loops made of sheep wool fibres, the method comprising:

fixing sheep wool fibres onto a surface of the backing layer; and knitting, weft-knitting or weave sheep wool fibre loops into the backing layer, wherein the polishing layer comprises surface weight of at least 500 g/m$^2$.

* * * * *